United States Patent [19]

Eichweber

[11] Patent Number: 4,854,595

[45] Date of Patent: Aug. 8, 1989

[54] FIREARM AIMING SIMULATOR DEVICE

[75] Inventor: Kurt Eichweber, Hamburg, Fed. Rep. of Germany

[73] Assignee: Precitronic Gesellschaft für Feinmechanic und Electronic mbH, Fed. Rep. of Germany

[21] Appl. No.: 93,053

[22] Filed: Sep. 3, 1987

Related U.S. Application Data

[63] Continuation of Ser. No. 15,594, Feb. 17, 1987, abandoned, which is a continuation-in-part of Ser. No. 781,159, Sep. 27, 1985, abandoned.

[30] Foreign Application Priority Data

Feb. 27, 1985 [DE] Fed. Rep. of Germany ..... 3507007

[51] Int. Cl.[4] ..... F41J 5/02

[52] U.S. Cl. ..... 273/312; 434/20

[58] Field of Search ..... 434/20–22; 273/310–312

[56] References Cited

U.S. PATENT DOCUMENTS

| | | | |
|---|---|---|---|
| 3,508,751 | 4/1970 | Meyer et al. | 273/310 X |
| 3,655,192 | 4/1972 | Hall et al. | 273/311 X |
| 4,195,422 | 4/1980 | Budmiger | 273/310 X |
| 4,218,138 | 8/1980 | Robertsson | 434/21 X |
| 4,218,834 | 8/1980 | Robertsson | 434/21 |
| 4,478,581 | 10/1984 | Goda | 273/312 X |
| 4,482,325 | 11/1984 | Reimann | 434/21 |
| 4,487,583 | 12/1984 | Brucker et al. | 273/311 |
| 4,496,158 | 2/1985 | Baer | 434/22 X |

FOREIGN PATENT DOCUMENTS

| | | | |
|---|---|---|---|
| 2748993 | 5/1979 | Fed. Rep. of Germany | 273/310 |
| 1439612 | 6/1976 | United Kingdom | 434/21 |

*Primary Examiner*—Leo P. Picard

*Attorney, Agent, or Firm*—Townsend and Townsend

[57] ABSTRACT

The device for practicing the aiming of a firearm at a target (5), which device comprises an optical aiming system for a light beam (11,12,13), more particularly a laser beam, directed at the target, at least one retro reflector (6) which is intended to reflect the light and which is fitted to the target (5), and arrangements for the observation of the reflected light, is characterized in that it comprises several different groups (1,2,3) of retro reflectors (6).

15 Claims, 2 Drawing Sheets

FIREARM AIMING SIMULATOR DEVICE

This is a continuation of Ser. No. 07/015,594 filed Feb. 17, 1987 now abandoned, which is a continuation-in-part of application Ser. No. 06/781,159, filed Sept. 27, 1985, now abandoned.

The invention relates to a device for practising the aiming of a firearm at a target, the device comprising an optical aiming system for a light beam, more particularly a laser beam, directed at the target, at least one retro reflector which is intended to reflect the light and which is fitted to the target, and arrangements for the observation of the reflected light.

With arrangements of this type, which are known for example from U.S. Pat. No. 4,229,103, it is possible to practise shooting with a firearm without shots actually being fired. In place of a shot, an (in most cases pulsed) laser beam is emitted, which is so directed that it hits the target at the place at which the shot would also hit the target. With such an arrangement, the laser beam is normally not emitted in a direction parallel to the axis of the shot, at least at relatively large distances, since, in contrast to the laser beam, the shot does not follow a rectilinear trajectory.

Whether the laser beam has now hit the target or not is determined with the aid of retro reflectors, which have the property of reflecting the light in exactly the direction from which it comes. The light which is reflected in this manner to the arrangement from which the laser pulse was emitted is an indication of the fact that the target has been hit.

For purposes of an effective simulation of military action, it not only matters whether the target has been hit at all, but also whether it has been hit at a place at which with live ammunition it would have been at least seriously damaged or even destroyed. As is known, certain parts of modern tanks are only vulnerable to a very slight extent with conventional shots, such as for example the front of a tank. Accordingly, if the front of a tank has been hit, this scarcely represents a success, in complete contrast to a shot as a result of which the target is finally removed from the action.

The object of the invention consists in providing a device of the initially described type, with which the positions at which a target has been hit can be assessed from the shot simulator.

According to the invention, this object is fulfilled in that the device comprises several different groups of retro reflectors.

Accordingly, the target has fitted thereto not just one retro reflector or, if the light spot is smaller than the target, a uniform pattern of retro reflectors, so that in normal circumstances in each instance one retro reflector or an invariable number of retro reflectors reflect the light. Instead of this, different groups of such retro reflectors are provided, in which the groups at particularly sensitive places of the target are differently designed or disposed as compared with places at which the target is less vulnerable or indeed only vulnerable to a very slight extent. If a part of the target which is particularly at risk, and thus a corresponding group of retro reflectors, are struck with the light spot, more particularly the laser beam, then the pattern of these retro reflectors can be discerned from the reflected light, so that from the shot simulator it is possible to establish that a lethal shot has taken place. If other group patterns are reflected, then it is known that parts of the target which are less at risk have been struck.

Advantageously, at least one group has a different number of retro reflectors from another. A group with more retro reflectors can for example be provided at a place at which the target is particularly vulnerable.

However, it is also to be preferred that the disposition of the retro reflectors relative to one another in at least one group is different from that in another, since in these circumstances the total light intensity is always the same. Thus, for example, the groups in the areas of the target which are particularly at risk could for example comprise retro reflectors which are disposed side by side, and the groups in other areas could comprise retro reflectors which are disposed one above the other. Other patterns or arrangements are, of course, possible.

It is also advantageous if the retro reflectors have a larger or smaller spacing from one another in at least one group relative to one another than in another. Combinations of these differences between the individual groups are also possible.

The arrangements for the observation of the reflected light can advantageously comprise a television camera and monitor. In this case, infrared light, more particularly an infrared laser, can for example be used. In the case of visible light, the reflected light could for example also be observed directly with field glasses.

If the targets have different distances, it is particularly expedient if the device comprises a distance-compensating optical system which maintains the cross-section of the light beam at the target at a constant size. In this manner, a situation can for example be prevented from arising in which, in the case of targets at large distances, light is simultaneously reflected by several groups of retro reflectors in consequence of the divergence of the beam, so that the result of the shot can no longer be evaluated.

In this arrangement, the optical system is expediently controlled by a rangefinder, more particularly a laser rangefinder.

The pattern of the reflected light could for example be analysed optically with the aid of appropriate optical enlarging arrangements such as telescopes, long focal length objectives and the like. However, advantageously an analysing arrangement is provided for the detection of the pattern of the reflecting group, which automatically establishes and indicates what type of group has been hit.

For the purposes of an effective simulation of military action, it will advantageously be provided that the device is provided with arrangements to take account of lead values in the case of moving targets. Expediently, the device is also provided with arrangements to take account of the ballistic trajectory of a shot. The appropriate corrections in the adjustment of the laser beam relative to the direction in which the shot is discharged can be computed with the aid of computers on the basis of the velocity of the target, the distance of the target, the nature of the simulated shot etc.

If arrangements for transmitting the result of the shot to the target are provided, it can for example be communicated to the target that it has been lethally hit. This permits a realistic simulation of military exercises, since following a lethal hit the moving target can cease its further activities. The arrangements for transmitting the result of the shot can for example in turn be laser arrangements.

The device according to the invention can not only be designed as a device for firing individual shots, but can also be designed as a scanning system. In this manner, in the course of the scanning operation it can likewise be established if a part of the target which is particularly at risk has been engaged.

The invention will be explained herein below with the aid of advantageous embodiments with reference to the accompanying drawing. In the drawing.

Figure 1:
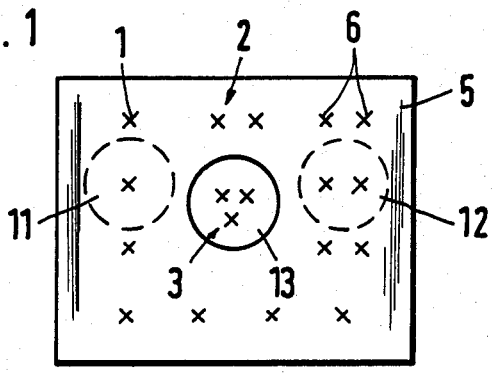
FIG. 1 shows the principle of different groups of retro reflectors.

FIG. 1 shows schematically a target 5, which comprises several retro reflectors indicated by crosses. These retro reflectors are arranged in the form of groups of retro reflectors. Accordingly, group 1 contains in each instance one retro reflector, while group 2 comprises retro reflectors disposed side by side. Group 3 comprises three retro reflectors, one of which is situated at the centre below two others which are disposed side by side. The groups could also be distinguished by the distance between their retro reflectors or by the orientation, as has already been explained above.

The light spot, for example of a laser beam, which impinges on the target 5, is designated by 11, 12 and 13 respectively. If for example a light spot 11 impinges on an element of group 1, that is to say one retro reflector, it is for example indicated by the corresponding reflected signal of a retro reflector that a very insensitive area has been hit. The light spot 12 covers two retro reflectors, which indicates for example an area which is at greater risk. However, the light spot 13 covers three retro reflectors of group 3, which can signify for example a lethal hit. At the same time, at the position of the light spot 13 the retro reflectors are arranged closer to one another than in the other groups, and this can also be utilised for identification.

Figure 2:
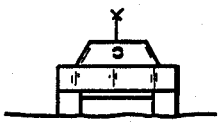
FIG. 2 shows the front of a tank vehicle.

On the front of the tank vehicle shown in FIG. 2, only one retro reflector can be seen as reference reflector above the turret. This corresponds to the fact that the tank is scarcely at risk from the front.

Figure 3:
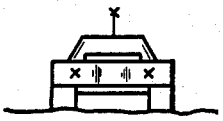
FIG. 3 shows the rear of a tank.

On the rear of the tank, which is represented in FIG. 3, two retro reflectors are provided (the additional retro reflector above the turret is also visible). The larger number of reflectors visible here corresponds to the fact that at the rear the tank can be eliminated from the military action even with low calibre ammunition.

Figure 4:
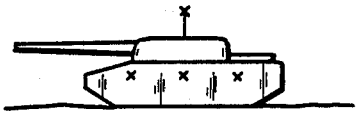
FIG. 4 shows a side elevation of a tank.

In FIG. 4, three retro reflectors are provided in the area which can receive a lethal hit. The further retro reflector above the central point of concentration of the target can also be seen as reference.

Figure 5:
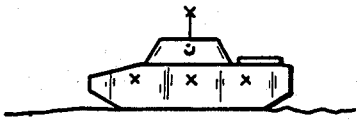
FIG. 5 shows a side elevation of the tank of FIG. 4, but with the gun pivoted to the side.

Finally, FIG. 5 shows the tank of FIG. 4 with the gun pivoted to the side. In this case also, it is possible to see in turn the three retro reflectors which are disposed side by side and the reference reflector disposed above the turret.

Figure 6:
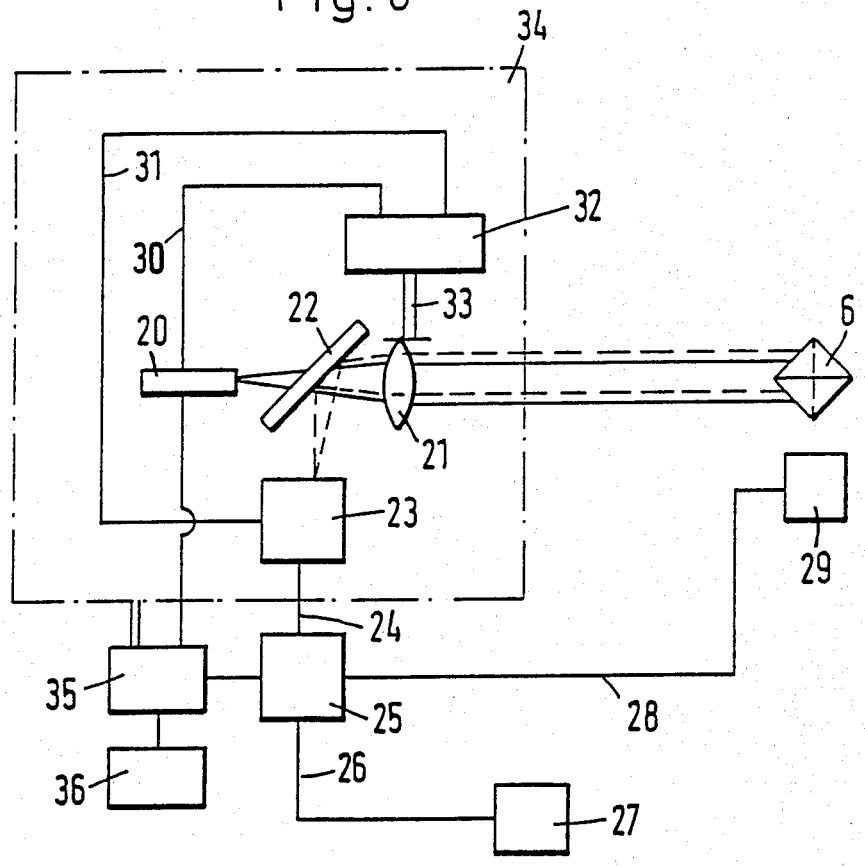
FIG. 6 shows the principle of the circuit arrangement for the generation and analysis of the light beam.

FIG. 6 shows schematically an arrangement for the generation and analysis of the light beams, more particularly laser beams.

The laser beams are generated in a laser 20 and directed with the aid of a lens system 21 to the retro reflector 6 or several of these retro reflectors, from where the beams pass again into the lens system 21 and are conducted through the semitransparent mirror 22 into a sensor arrangement 23, for example a television camera. The electrical signals then pass via the lead 24 to an analysing circuit 25 and subsequently via a lead 26 to an indicating arrangement 27, for example a television monitor. At the same time, the signals can however also be conducted from the analysing circuit 25 via a lead 28 (which can for example also be a radio link) to a further indicating arrangement 29, which is situated at the target. In this case, persons situated at the target can then establish whether a hit has taken place.

Instead of a television or video camera, sensor arrangement 23 could be a matrix charge coupled device (CCD) camera. CCD cameras have the advantage with respect to conventional television or video cameras in that the image area is arranged in the form of a matrix such that direct access to every image point is possible for a calculating device. In contrast, in a television or video camera, normally the image points are scanned such that one has access to an image point only once during every recording or scanning cycle for each image.

The laser 20 is connected via a lead 30, and the sensor arrangement 23 via a lead 31 with a rangefinder 32, in which a transit time measurement is carried out. At the same time, the lens system 21 can be so adjusted by mechanical arrangements which are not shown, with the aid of the rangefinder 32, via appropriate adjusting arrangements which are indicated at 33, that the cone of light arriving at the retro reflector 6 always has substantially the same diameter. The system consisting of the laser 20, the semitransparent mirror 22, the lens system 21 and the detector 23 can also be pivotably disposed on a unit which is schematically represented at 34. In this arrangement, this unit can be pivoted with the aid of a drive arrangement 35 on the basis of control by the analysing circuit 25, it also being possible for data to be fed in manually at a data input 36, e.g. for the shot to be employed. In this manner, the lead in the case of moving objects can be practised automatically with the device according to the invention. Furthermore, an entire area of the target can also be scanned automatically. In addition to this, data concerning a ballistic trajectory can be fed in, in order in this manner to practise aiming under conditions which are as far as possible in accordance with reality.

The arrangement of retro reflectors according to the invention can be implemented easily. The expenditure is small and also permits the user to exercise a high degree of flexibility, since he himself can mark sensitive zones in accordance with ballistics and tactical training by fitting the retro reflectors in an appropriate manner. A further advantage consists in that the so-called hull down positions which are to be recorded in accordance with tactical training serve to cover the reference reflectors. A hull down position is present when a tank takes up position for example behind a wall of sand or a hill.

I claim:

1. A system for practicing aiming a firearm at a target comprising:

a target having first and second target areas with first and second degrees vulnerability, respectively;

first and second groups of retroreflectors mounted to the first and second target areas, respectively, the first and second groups of retroreflectors arranged in first and second visually distinguishable patterns with first and second densities, respectively; and an optical aiming system for directing an electromagnetic beam at the target and for receiving electromagnetic radiation reflected back from one of the groups of retroreflectors.

2. The system of claim 1 further comprising: an indicating system, coupled to the optical aiming system, for providing an indication of the target area illuminated by the electromagnetic beam.

3. The system of claim 2 wherein the indicating system includes a television type monitor to permit a user to visually ascertain the degree of vulnerability of the target area illuminated by the electromagnetic beam based upon the pattern of the retroreflectors in the group of retroreflectors illuminated by the electromagnetic beam.

4. The system of claim 2 further comprising a second one of said indicating system, positioned near the target.

5. The system of claim 1 further comprising a plurality of said first target areas.

6. The system of claim 1 wherein the target has a third target area with a third degree of vulnerability, and further comprising a third group of retroreflectors mounted to the third target area, the third group of retroreflectors arranged in a third pattern visually distinguishable from the first and second patterns.

7. The system of claim 6 wherein said first pattern includes a single retroreflector, said second pattern includes two closely horizontally spaced retroreflectors, and said third pattern includes three retroreflectors in a closely spaced triangle.

8. The system of claim 6 wherein the third visually distinguishable pattern comprises the retroreflectors mounted to the third target area with a third density.

9. The system of claim 1 wherein the electromagnetic beam is a laser beam and the optical system includes a laser beam source for producing the laser beam and directing the laser beam through a lens system towards the target.

10. The system of claim 1 wherein the electromagnetic beam has a chosen cross-sectional size at the target, and further comprising a distance compensating optical system for maintaining said chosen cross-sectional size constant irrespective of the distance between the target and the optical aiming system.

11. The system of claim 10 wherein the distance compensating optical system includes a range finder.

12. The system of claim 1 further comprising means for adjusting the direction of the electromagnetic beam for lead values required for compensation when the target is a moving target.

13. The system of claim 1 wherein the firearm includes a ballistic projectile, the ballistic projectile having a ballistic trajectory, and further comprising means for adjusting the direction of the light beam to compensate for the ballistic trajectory.

14. The system of claim 1 wherein each said group of retroreflectors has a different number of retroreflectors, the number of retroreflectors for each group defining the degree of vulnerability for the respective target area.

15. A system for practicing aiming a firearm at a target comprising:

a target having first and second target areas with first and second degrees vulnerability, respectively;

first and second groups of retroreflectors mounted to the first and second target areas, respectively, the first and second groups of retroreflectors arranged in first and second visually distinguishable patterns, respectively;

an optical aiming system for directing an electromagnetic beam at the target and for receiving electromagnetic radiation reflected back from one of the groups of retroreflectors; and a charge coupled device type camera for electronically detecting the pattern of retroreflectors illuminated by the electromagnetic beam.

* * * * *